US006544349B1

(12) United States Patent
Donahue et al.

(10) Patent No.: US 6,544,349 B1
(45) Date of Patent: Apr. 8, 2003

(54) METHOD FOR IN SITU CLEANING OF MACHINE COMPONENTS

(75) Inventors: Donald R. Donahue, Rockford, IL (US); Frank J. Miller, Ormond Beach, FL (US)

(73) Assignee: The Fanning Corporation, Chicago, IL (US)

( * ) Notice: Subject to any disclaimer, the term of this patent is extended or adjusted under 35 U.S.C. 154(b) by 64 days.

(21) Appl. No.: 09/714,773

(22) Filed: Nov. 16, 2000

(51) Int. Cl.[7] ..... C23G 1/00

(52) U.S. Cl. ..... 134/41; 134/2; 134/3; 134/36; 510/245; 510/254; 510/437; 510/488; 510/491

(58) Field of Search ..... 134/2, 3, 36, 41; 510/245, 254, 437, 488, 491

(56) References Cited

U.S. PATENT DOCUMENTS

| | | | | | |
|---|---|---|---|---|---|
| 2,186,346 | A | * | 1/1940 | Ricketts | 87/9 |
| 2,371,333 | A | * | 3/1945 | Johnston | 252/56 |
| 2,717,241 | A | * | 9/1955 | Hook | 252/32.7 |
| 3,244,631 | A | * | 4/1966 | van der Voort | 252/56 |
| 3,282,665 | A | * | 11/1966 | Myers | 51/304 |
| 3,835,169 | A | | 9/1974 | Kraft et al. | 552/545 |
| 3,996,888 | A | * | 12/1976 | Iofdahl et al. | 118/70 |
| 4,066,789 | A | | 1/1978 | Mores et al. | 424/365 |
| 4,154,779 | A | | 5/1979 | Kreutzer | 558/113 |
| 4,234,497 | A | | 11/1980 | Honig | 554/172 |
| 4,314,907 | A | | 2/1982 | Defretin et al. | 508/112 |
| 4,374,168 | A | * | 2/1983 | Wojtowicz | 428/212 |
| 4,609,376 | A | | 9/1986 | Craig et al. | 44/397 |
| 4,787,995 | A | | 11/1988 | Nichols et al. | 508/451 |
| 4,920,691 | A | * | 5/1990 | Fainman | 44/57 |
| 5,234,612 | A | | 8/1993 | Carlisle | 508/259 |
| 5,348,678 | A | * | 9/1994 | Hodam, Jr. et al. | 252/106 |
| 5,451,331 | A | | 9/1995 | O'Connor et al. | 508/339 |
| 5,512,190 | A | | 4/1996 | Anderson et al. | 508/231 |
| 5,556,970 | A | | 9/1996 | Kawasaki et al. | 554/190 |
| 5,584,943 | A | * | 12/1996 | Banaszak et al. | 148/246 |
| 5,627,146 | A | * | 5/1997 | Tanaka et al. | 508/363 |
| 5,693,600 | A | * | 12/1997 | Hendricksen et al. | 510/170 |
| 5,744,053 | A | * | 4/1998 | Kaimai | 252/68 |
| 5,780,400 | A | * | 7/1998 | MacNeil et al. | 508/496 |
| 5,942,581 | A | * | 8/1999 | Nakamura et al. | 525/309 |

FOREIGN PATENT DOCUMENTS

| | | | |
|---|---|---|---|
| JP | 359068396 | * | 4/1984 |
| JP | 408073883 | * | 3/1996 |

OTHER PUBLICATIONS

Mallinckrodt Baker, Inc., Lanolin; pp. 1–7; Sep. 11, 2000; Internet (www.jtbaker.com).

SURU Chemicals and Pharmaceuticals, Limited, Unequaled Quality in Lanolin; pp. 1–3; Sep. 11, 2000; Internet (www-.suru.com).

ASTM Standards Source, ASTM Standards Source Petroleum Collection; pp. 1–11; Oct. 25, 2000; Internet (www.astm.org).

Noria, Oil Analysis.com Simple Dilanalysis Solutions; pp. 1–5; Oct. 25, 2000; Internet (www.noria.com).

Rolex Lanolin Products Limited, What is Lanolin; pp. 1–2; May 11, 2000; Internet (www.rolexlanolin.com).

WordPro Designs, Inc., Total Lubrication System Cleaning Solution; pp. 1–6; Feb. 14, 2000; Internet (www.wordpro-.net).

MTX Products, Triple XXX; pp. 1–10; Feb. 10, 2000; Internet (www.wordpro.net).

A product named "Triple XXX," which contains esters of naturally–occurring fatty acids, was offered for sale by inventor Frank Miller as a metal cleaning agent on the Internet for approximately seven days starting at the beginning of the last week of Nov. of 1999. The name of this product was quickly changed to "Auto–Rx®" (due to confusion of the name "Triple XXX" by Internet users with pornographic material).

A product named "Auto–Rx®", which had previously been named "Triple XXX," and that contains esters of naturally–occurring fatty acids, has been offered for sale to the public by inventor Frank Miller as an agent for cleaning internal engine parts since Dec. of 1999.

A product named "NATRALUBE," which contains esters of naturally–occurring fatty acids, has been offered for sale to the public as a lubricant additive by The Fanning Corporation since Oct. of 1996, with the first public sale occurring in Jan. of 1997.

* cited by examiner

*Primary Examiner*—Sharidan Carrillo
(74) *Attorney, Agent, or Firm*—Roberta L. Hastreier; Scott B. Feder; Lord, Bissell & Brook

(57) ABSTRACT

A method is provided for in situ cleaning of lubricated parts of a machine in which the machine is operated with a lubricating fluid that contains an effective concentration of a cleaning composition comprising a synthetic ester of a naturally occurring fatty acid for an amount of time sufficient to remove from the lubricated parts adhered debris which is not removed by the lubricating fluid conventionally used in the machine.

14 Claims, No Drawings

METHOD FOR IN SITU CLEANING OF MACHINE COMPONENTS

FIELD OF THE INVENTION

This invention relates to methods for cleaning internal parts of a machine and, more particularly, to methods for in situ cleaning of internal or inaccessible metal parts and rubber or silicone seals, using a synthetic ester of a naturally occurring fatty acid.

BACKGROUND OF THE INVENTION

Internal components of machines such as internal combustion engines, mechanical gearboxes, printing presses, compressors, hydraulic systems and the like often become contaminated during normal use when foreign matter or debris (lubricant degradation products such as carbon and varnish) is deposited on surfaces of parts and behind oil seals which often are not easily accessible for cleaning. These internal parts often mate or mesh with other parts of the machine or, in the case of seals, prevent oil or lubricant from leaking from the lubrication system, and are typically lubricated during operation. Lubricants, such as oil or grease, are sometimes capable of trapping loose debris that can be harmful to the machine, and it is common practice to periodically change the lubricant. Changing the lubricant, however, does not remove adhered debris or deposits from the metal parts of the machine or trapped behind oil seals. For example, in an internal combustion engine, changing the lubricant does not remove carbon deposits that adhere to pistons, rings, valves, cylinder heads and the like, and lead to deteriorization, decreased engine power and increased wear. In other machines, such as printing presses, accumulation of debris on rubber or silicone seals used to seal rotating or moving parts, or on moving metal parts that mate or mesh with each other, can adversely affect lubrication, performance and the useful life of the seals and other mechanical parts.

To remove adhered or accumulated debris that is not taken up and circulated in the conventional lubricating fluid used in the machine during operation, it is often necessary to disassemble the machine to clean the parts and/or replace the oil seals. Prior to introduction of strict environmental standards by the U.S. Environment Protection Agency (EPA) and similar agencies, it was common to clean metal components of various industrial machines using volatile organic compounds, such as hexane, benzene, toluene, methylethylketone and the like. It is time consuming to manually clean gears, chains, bearings other mechanical parts of machines. To avoid having to disassemble a machine to clean internal parts individually, it would be advantageous to provide effective and environmentally acceptable cleaning compositions for in situ cleaning of internal or otherwise inaccessible metal parts of a machine while the machine operates.

SUMMARY OF THE INVENTION

We have, surprisingly, found that synthetic esters of naturally occurring fatty acids provide effective cleaning compositions which, when added to the conventional lubricant in a machine having moving metal parts that are lubricated during operation, can clean those parts in situ, as well as remove debris that is lodged on or behind oil seals, while the machine is operating. The inventive method also has been found to reduce or inhibit oil leaks in such machines that can result from an accumulation of debris on or behind the oil seals of the machine. The method of the invention can increase the longevity and/or effectiveness of the oil seals. The cleaning compositions comprise a synthetic ester of a naturally occurring fatty acid, such as lanolin fatty acid, tall oil fatty acid, tallow fatty acid, coconut oil fatty acid or the like, wherein the alkyl moiety of the ester group is a straight or branched chain alkyl moiety having from about 6 to 20 carbon atoms. A presently preferred cleaning composition is provided by a synthetic ester prepared from the reaction of lanolin fatty acid and 2-ethylhexanol (i.e., an ester of lanolin fatty acid, wherein the ester group contains a 2-ethylhexyl moiety). The fatty acid esters described herein are environmentally desirable, yet possess very effective cleaning properties.

DETAILED DESCRIPTION OF THE INVENTION

In one of its aspects, the present invention entails a method for cleaning lubricated metal parts of a machine to remove debris adhered to the parts, comprising the step of operating the machine so that a circulating lubricant composition having a cleaning effective concentration of a synthetic ester of a naturally occurring fatty acid contacts the metal parts for an amount of time sufficient to clean adhered debris from the metal parts while the machine is operating.

In another of its aspects, the present invention entails a method for cleaning lubricated oil seals of a machine to remove debris accumulated at the oil seal, especially behind the oil seal, comprising the step of operating the machine so that a circulating lubricant composition having a cleaning effective concentration of a synthetic ester of a naturally occurring fatty acid contacts the oil seal and the debris accumulated at the oil seal for an amount of time sufficient to clean adhered or accumulated debris from the oil seal while the machine is operating. In this aspect of the invention, it has been found that oil seals made of rubber or silicone, when treated in the method of the present invention can have an increased effectiveness and longevity. Moreover, the method of the invention can inhibit or stop oil leaks occurring at the oil seals where the oil seal itself is not cracked or irreparably damaged.

The phrase "synthetic ester of a naturally occurring fatty acid" as used herein, means an ester that is formed such as in an esterification reaction between a naturally occurring fatty acid and an alcohol or other reactant capable of esterifying the fatty acid. The term "naturally occurring fatty acid" includes fatty acids that may be extracted from animal or plant material, or that may be chemically derived from their corresponding waxes, as is well known in the art. As used herein "naturally occurring fatty acid" includes lanolin fatty acid, coconut oil fatty acid, tall oil fatty acid, tallow fatty acid and the like, as well as saturated, monounsaturated and polyunsaturated fatty acids, such as myristic acid, palmitic acid, stearic acid, arachidic acid, myristoleic acid, palmitoleic acid, oleic acid, linoleic acid and the like, and mixtures of such fatty acids. Esters of lanolin fatty acid, coconut oil fatty acid, tall oil fatty acid and tallow fatty acid are presently preferred for use in accordance with the present invention. These and other fatty acids are commercially available. They may also be provided by saponification of their corresponding naturally occurring waxes, as is known in the art.

The phrase "debris accumulated on the parts" means lubrication degradation products which are adhered to or accumulated on parts of the machine such that the debris is not suspended or dissolved in conventional lubricating oil that circulates while the machine is operating, but is capable of being suspended or dissolved in lubricating oil supplemented with a cleaning effective concentration of a synthetic ester of a naturally occurring fatty acid, as described herein, while the machine is operating. The phrase "debris accumulated on the parts" includes lubricant degradation products such as carbon, varnish or brown carbon (as the term is used in the printing press field),that are adhered to the parts or are trapped in areas where the lubricant circulates, such as behind oil seals or the like.

The term "adhered debris," or variation thereof, as used herein, refers to carbon deposits, varnish, and other foreign deposits that become bound to metal parts of a machine during normal operation in the presence of an oil or lubricant which lacks the synthetic fatty acid esters cleaning compositions described herein.

A "cleaning-effective concentration," as used herein, means a concentration of a synthetic ester of a naturally occurring fatty acid that is capable of cleaning a detectable amount of debris from the metal parts or oil seals of a machine during operation for a predetermined period of time as compared to the amount of debris removed by conventional lubricant used in the machine. With respect to the cleaning composition described in Example 1 herein, a cleaning-effective concentration is at least about 2% (by volume) of the composition of Example 1, based on the total volume of the cleaning composition including any diluents and additives. It is presently preferred to use an amount of a synthetic ester of a naturally occurring fatty acid that is between about 1% and about 20% (by volume) or more, based on the total volume of the lubricant/cleaning composition. The term "lubricant/cleaning composition" or similar term means a conventional lubricant used in the machine to be cleaned supplemented with the cleaning composition described herein, including any lubrication additives. The lubricating ability of such an engine oil, hydraulic fluid or other lubricating fluid that has been supplemented with a cleaning composition described herein may be readily determined by the Four Ball EP Test, Timken OK Load Test, Vickers Pump Test or Falex Pin and Vee Tests, as is known in the art.

When used for cleaning hydraulic systems and compressors, it is presently preferred that, in acordance with the method of the present invention, a cleaning composition comprising a synthetic ester of a naturally occurring fatty acid be used at a concentration of about 2–3% (v/v) in a conventional hydraulic fluid or compressor fluid (e.g., petroleum oil or an ester-based lubricant such as tridecyladipate, tridecylphthalaie, trimethylpropane or a pentaerythritol based lubricant), as is known in the art. When used for cleaning an internal combustion engine or an industrial gearbox: it is presently preferred that a synthetic ester of a naturally occurring fatty acid be used at a concentration of about 3–10% (v/v) in the engine oil or gearbox fluid (e.g., oil or ester-based lubricant). The amount of the cleaning composition containing a synthetic ester of the naturally occurring fatty acid ester may be varied according to the specific application, as will be readily appreciated by those of prdinary skill in the art.

The lubricating system df printing presses, such as sheet fed offset presses and web offset presses, may be cleaned in accordance with the method of the present invention by using a cleaning composition comprising a synthetic ester of a naturally occurring fatty acid at a concentration of about 2.5%–12% (v/v) in a conventional oil (e.g., high detergent oil) as is known in the art. It is also contemplated as within the scope of the present invention to supplement a conventional lubricating oil of a printing press (or other machine) with a concentration of the cleaning compositions which is about one-quarter to one-half the concentration used for a cleaning operation and use the lubricant containing such a lower concentration of cleaning composition as a substitute or replacement for the conventional lubricating oil in order to keep the lubricating oil clean over an extended period of operation and to increase the longevity and effectiveness of the oil seals, particularly where the seals are composed of silicone or buna rubber.

In a presently preferred aspect of the present invention, the synthetic ester of a naturally occurring fatty acid is an ester of lanolin fatty acid, wherein the alkyl group (R) of the ester ($CO_2R$) is a straight chain or branched alkyl moiety having from about 6 to 20 carbon atoms. Lanolin originates as a unique substance secreted by sheep from special sebaceous glands in their skin so as to form a natural protective coating on the wool. This unique substance is a crude wax which is different from the body fat of animals. The crude wax is obtained as a natural by-product from the shearing and washing of sheep's wool. The crude wax is commonly referred to as wool grease. A series of refining processes converts the wool grease into lanolin fatty acid. Lanolin is a mixture of esters, di-esters, and hydroxy esters of high molecular weight lanolin alcohols and high molecular weight lanolin acids. Common uses of lanolin, which is commercially available in 5 grades, include rust protection, personal care products, and pharmaceutical applications. In accordance with the present invention, it is preferred to use a synthetic ester of lanolin fatty acid made from the U.S. Pharmacopeia (USP) grade of lanolin. While the presently preferred fatty acid ester compositions described herein are based on lanolin fatty acid, it will be appreciated that other natural fatty acids may be used including coconut oil fatty acid, tall oil fatty acid, tallow fatty acid and the like, as well as individual saturated, monounsaturated and polyunsaturated fatty acids or mixtures thereof.

In accordance with the present invention, esterification of fatty acids to yield synthetic esters of a naturally occurring fatty acid may be carried out by various methods that are well known in the art. In presently preferred embodiments of the invention, lanolin fatty acid is esterified in an acid catalyzed esterification reaction by heating lanolin fatty acid and a straight or branched chain alcohol having from about 6 to about 20 carbon atoms in the presence of an acid catalyst such as methanesulfonic acid. Among alcohols which may be used to esterify the fatty acid are hexanol, heptanol, octonal, nonanol, decanol, undecanol, dodecanol and the 2-alkyl- and 3-alkyl-derivatives of such alcohols (wherein alkyl is defined to include methyl, ethyl and propyl), such as 2-methylhexanol, 2-ethylhexanol, 3-ethylhexanol, 2-ethylheptanol, 2-ethyloctanol, 2-propyloctanol, 2-ethyldecanol and the like. A mixture of two or more alcohols may also be used in the esterification reaction, as well as polyols having between about 6 and 20 carbons atoms, such as pentaerythritol or the like.

Preparation of a presently preferred synthetic fatty acid ester for use in the method of the present invention is carried out by combining in a suitable reaction vessel about 75 to 80 parts by volume of lanolin fatty acid, about 20 to 25 parts by volume of 2-ethylhexanol, and about 0.2 to 1.0 parts by volume of methanesulfonic acid (or other acid catalyst such as phosphoric acid). The reaction mixture should be blanketed with a slight atmosphere of nitrogen and heated to a temperature of between about 250° F. and 350° F., preferably about 300° F. and 350° F. to allow the esterification reaction to proceed. Water, which is generated in the reaction, is removed using a conventional condenser apparatus as is known in the art. The reaction is carried out for between about 1 to 3 hours or more, until the reaction is completed as determined by monitoring the acid value (AV) of the reaction mixture until a minimum value less than about 12, and preferably less than 10, is achieved. The theoretical yield of the reaction is about 94%.

Thereafter, the reaction mixture is cooled to about 125° F. and the synthetic ester of lanolin fatty acid is optionally blended with (i) an effective concentration of a chlorine-fiee extreme pressure additive composition (generally, about 2%–4% or more by volume), and/or (ii) an effective concentration of a lubricity additive composition (generally, about 2%–4% or more by volume). Chlorine-free extreme pressure additives, which provide excellent resistance to shear and hydrolysis, are well known and commercially available. Extreme pressure additives are lubricant additives that prevent sliding metal surfaces from seizing under conditions of extreme pressure. At the high local temperatures associated with metal-to-metal contact, an extreme pressure additive can combine chemically with a metal to form a surface film that inhibits scoring that is destructive to sliding surfaces under high loads. A presently preferred chlorine-free extreme pressure additive is DOVERLUBE® B902 chlorine-free extreme pressure additive (i.e., a heptanoic acid ester of cyclohexane dimethanol), available from Dover Chemical Corporation, 3676 Davis Road N. W., Dover, Ohio 44622. The cleaning compositions described herein may be tested to aetermune an effective concentration of a chlorine-free extreme pressure additive using, for example, the Falex Pin and Vee Block Method (ASTM D 3233-93 (1998), the Four Ball Method (ASTM D-2783-88 (1998) or the Timken Method (ASTM D-2782-94 (1991)).

Lubricity additives, which increase film strength of oils and greases, are also well known and commercially available. The cleaning compositions described herein may be tested to determine an effective concentration of a lubricity additive using, for example, the Falex Pin and Vee Test or the Four Ball Wear Test, as is known in the art. A presently preferred lubricity additive composition is DOVERLUBE® FL219 lubricity additive (pentaerythritol ietraoleate).

The chlorine-free extreme pressure additive and the lubricity additive may be blended into the reaction mixture comprising the 2-ethylhexyl ester of lanolin fatty acid by any conventional mixing method. The blended cleaning composition should be liquid at temperature above about 55–65° F. The amount of lubricity additive (e.g., pentaerythritol tetraoleate) may be increased or decreased as necessary to achieve a blended cleaning composition that is liquid at the desired temperature. The resulting cleaning composition comprising a synthetic ester of a naturally occurring fatty acid, along with an extreme pressure additive and a lubricity additive, should preferably have the following physical and chemical properties:

| | |
|---|---|
| Saponification Value: | between about 115 and 135 |
| Acid Value: | less than about 16 (mg KOH/g) |
| Hydroxyl Value: | between about 50 and 75 |
| Moisture: | less than 1% |
| Ash: | less than 0.5% |
| Specific Gravity | between about 0.898 and 0.917 |
| Unsaponifiable: | about 12% |
| Pour Point: | between about 45° F. and 55° F. |
| Viscosity: | SUS @ 100° F. between about 300 and 500 |
| | SUS @ 210° F. between about 55 and 65 |
| Pin and Vee Value: | Not less than about 4000 lbs. |
| Coefficient of Friction | 0.068–0.070 |
| Timken OK Load -LB | 50–80 (tested after addition to lubricating fluid) |

A cleaning composition in accordance with this specification, which comprises a 2-ethylhexyl ester of lanolin fatty acid is commercially available from The Fanning Corporation, 2450 W. Hubbard St., Chicago Ill. 60612, under the product name NATRALUBE® 1006.

The synthetic esters of the naturally occurring fatty acid described herein, may be further diluted by conventionally mixing additional amounts of a chlorine-free extreme pressure additive composition (up to about 25% by volume) and/or a lubricity additive composition (up to about 20% by volume) based on the total volume of the final volume of the cleaning composition comprising a synthetic ester of a naturally occurring fatty acid, provided that the cleaning composition comprises at least about 55% v/v of a synthetic ester of the naturally occurring fatty acid. Such a product may have a pour point of about 30° F.

To ensure sufficient lubricating ability for the cleaning composition comprising a cleaning effective concentration of a synthetic ester of a naturally occurring fatty acid, the cleaning composition is used as a supplement to conventional lubricants which are miscible with the cleaning compositions described herein, including petroleum-based oils, greases, hydraulic fluids, compressor fluids, ester-based lubricants and the like.

The amount of time that will be sufficient for in situ cleaning of the internal parts of the machine will vary according to the application, as will be appreciated to those of ordinary skill in the art. For example, where it is desired to clean the internal parts of an internal combustion engine of an automobile, the automobile may be driven from about 200 to 500 miles or more with the engine filled with engine oil containing, e.g., about 3%–10% of cleaning composition comprising a synthetic ester of a naturally occurring fatty acid as described herein. After the cleaning composition has cleaned the internal parts of the engine, e.g., pistons, rings, valves, etc., the spent cleaning composition is simply removed from the engine and replaced with engine oil. Where the cleaning composition is used to clean industrial machines, such as compressors, enclosed gearboxes, hydraulic systems or the like, the compressor, gearbox or hydraulic system is filled with its conventional lubricating fluid supplemented with an appropriate amount of the cleaning composition and operated for a period of about 100–200 hours, after which time the spent cleaning composition is removed and replaced with conventional lubricating fluid.

The following nonlimiting examples further describe the preparation of the compounds of the invention.

EXAMPLE 1

Five thousand, four hundred eight (5,408) pounds of NATRALURE® 210 lanolin fatty acid (The Fanning Carporation, Chicago, Ill. 60612), 1,558 pounds of 2-ethylhexanol and 35 pounds of methanesulfonic acid are charged into a 1000-gallon reactor. A slight blanket of nitrogen is introduced into the reaction and the reaction mixture is heated to 330° F. with the reactor overheads open and the condenser cooled to remove water generated in the reaction. The reaction is allowed to proceed with testing of the acid value of the reaction mixture each hour. After three hours, the acid value is found to be less than 12, and the reaction is stopped by cooling to room temperature. One hundred forty (140) pounds of a chlorine-free extreme pressure additive (DOVERLUBE® B902 chlorine-free extreme pressure additive) and 140 pounds of pentaerythritol tetraoleate (DOVERLUBE® FL219 lubricity additive) are blended into the reaction mixture to provide a blended mixture that may be used in the method of the present invention for cleaning metal components of a machine.

EXAMPLE 2

An automobile engine with over 100,000 miles on it and having carbon deposits on internal metal surfaces is treated by draining the engine oil, installing a new oil filter, and adding fresh engine oil supplemented with 5% v/v of the cleaning composition of Example 1 ("supplemented engine oil"). The automobile is driven 500 miles with the supplemented engine oil. The supplemented engine oil is drained, another new oil filter is installed, and fresh engine oil is added to the engine. A visual inspection of the cylinder heads and pistons, before and after treatment, reveals that the engine components are cleaned by the treatment with the cleaning composition of Example 1.

EXAMPLE 3

An automobile engine with over 100,000 miles on it and emitting levels of hydrocarbon and nitrogen oxide ($NO_x$) greater than those permitted by law is treated by draining the engine oil, installing a new oil filter, and adding fresh engine oil supplemented with 5% v/v of the cleaning composition of Example 1 ("supplemented engine oil"). The automobile is driven about 500 miles with the supplemented engine oil. The supplemented engine oil is drained, the oil filter is replaced with another new oil filter, and fresh engine oil is added. The automobile is then driven for 1500 miles with the new oil (without supplementation with cleaning composition) and thereafter an amount of the cleaning composition is added to the engine oil so that it is supplemented with the cleaning composition at a concentration of about 5% v/v and the automobile is driven another 500 miles. Thereafter, the oil and filter are replaced with fresh oil (without supplementation with the cleaning composition). After the above in situ treatment with the cleaning composition of Example 1, the levels of hydrocarbon emissions and nitrogen oxide emission are reduced to a level permitted by law.

EXAMPLE 4

The high detergent lubricating oil (ISO 100) is removed from the lubricant sump of a sheet fed offset press in need of cleaning, and replaced with high detergent ISO 100 oil supplemented with 5.5% (v/v) of the cleaning composition of Example 1. The sheet fed offset printing press is operated under normal operating conditions for 300 hours, cleaning or replacing the oil filter as necessary, and the spent lubricating oil/cleaning composition, having cleaned the parts of the printing press which were in contact with the cleaning composition, is drained from the lubricant sump and replaced with fresh ISO 100 oil, optionally supplemented with about 2.7% of the Example 1 composition.

EXAMPLE 5

The high detergent lubricating oil (ISO220) is removed from the lubricant sump of a web offset press in need of cleaning and replaced with high detergent ISO 220 oil supplemented with 11% (v/v) of the cleaning composition of Example 1. The web offset printing press is operated under normal operating conditions for 300 hours, cleaning or replacing the oil filter as necessary, and the spent lubricating oil/cleaning composition, having cleaned the parts of the printing press which were in contact with the cleaning composition, is drained from the lubricant sump and replaced with fresh ISO 100 oil, optionally supplemented with about 5.5% (v/v) of the Example 1 composition.

EXAMPLE 6

The hydraulic fluid is removed from the hydraulic system of an industrial machine in need of cleaning and replaced with hydraulic fluid supplemented with 3% (v/v) of the cleaning composition of Example 1. The hydraulic system is operated under normal operating conditions for 100 hours, and the spent hydraulic fluid/cleaning composition, having cleaned the metal parts of the hydraulic system which were in contact with the cleaning composition, is drained and replaced with fresh hydraulic fluid.

EXAMPLE 7

The gearbox oil is removed from an enclosed gearbox of an industrial machine in need of cleaning and replaced with gearbox oil supplemented with 5% (v/v) of the cleaning composition of Example 1. The gearbox is operated under normal operating conditions for 200 hours, and the spent gearbox oil/cleaning composition, having cleaned the metal parts of the gearbox which were in contact with the cleaning composition during operation, is drained from the sump and replaced with fresh lubricating oil.

EXAMPLE 8

The gearbox oil of a gearbox of a sheet fed offset printing press, which gearbox is in need of cleaning, was drained and replaced with gearbox oil supplemented with 5% (v/v) of the cleaning composition of Example 1. The gearbox is operated under normal operating conditions for 300 hours, and the spent gearbox oil/cleaning composition, having cleaned the metal parts of the gearbox which were in contact with the cleaning composition during operation, is drained from the sump and replaced with fresh lubricating oil.

The present invention has been described herein with some specificity and with reference to certain preferred embodiments thereof Those persons having ordinary skill in the art will appreciate variations, modifications and substitutions which may be made to what has been described without departing from the scope and spirit of the invention which is defined by the following claims. The publications, technical specifications and patents which have been cited herein are hereby incorporated into this document by this reference.

We claim:

1. A method for cleaning internal lubricated parts of a machine to remove debris accumulated on the internal lubricated parts, compising the step of operating the machine under normal operating conditions so that a lubricant composition comprising a lubricating fluid, a chlorine-free extreme pressure additive comprising a heptanoic acid ester of cyclohexane dimethanol, a lubricity additive comprising a pentaerythritol tetraoleate and a cleaning composition comprising a cleaning effective concentration of a synthetic ester of a naturally occurring fatty acid contacts the internal lubricated parts while the machine is operating under normal operating conditions for an amount of time sufficient to clean accumulated debris from the internal lubricated parts.

2. The method of claim 1 wherein the ester group of the synthetic ester of a naturally occurring fatty acid comprises a linear or branched alkyl moiety having from about 6 to 15 carbon atoms.

3. The method of claim 1 wherein the machine is selected from the group consisting of an internal combustion engine and a gearbox, and the cleaning composition contains front about 3% to 10% (v/v) of the synthetic ester of a naturally occurring fatty acid.

4. The method of claim 1 wherein the machine is selected from the group consisting of compressors and hydraulic systems and the cleaning composition contains from about 2% to 3% (v/v) of the synthetic ester of a naturally occurring fatty acid.

5. The method of claim 1 wherein the machine is a printing press having at least one oil seal that contacts and seals a moving part of the machine to inhibit oil from passing between the seal and the moving part.

6. The method of claim 2 wherein the synthetic ester of a naturally occurring fatty acid is a synthetic ester of a naturally occurring fatty acid selected from the group consisting of lanolin fatty acid, tall oil fatty acid, tallow fatty acid and coconut oil fatty acid.

7. The method of claim 5, wherein the oil seal is composed of rubber.

8. The method of claim 5, wherein the oil seal is composed of a material which is buna rubber or silicone.

9. The method of claim 6 wherein the synthetic ester of a naturally occurring fatty acid is a synthetic ester of lanolin fatty acid.

10. The method of claim 8, wherein the printing press is a sheet fed offset press.

11. The method of claim 8, wherein the printing press is a web offset press.

12. The method of claim 9 wherein the ester group of the synthetic ester of a naturally occurring fatty acid contains a 2-ethylhexyl ester of lanolin fatty acid.

13. The method of claim 9, wherein the cleaning composition contains between about 2% to 10% by volume of the synthetic ester of a naturally occurring fatty acid.

14. The method of claim 13 wherein the lubricant composition contains between about 2% and 25% (v/v) of the heptanoic acid ester of cyclohexane dimethanol and between about 2% and 20% (v/v) of the pentaerythritol tetraoleate.

* * * * *